United States Patent [19]

Reiter

[11] 4,163,132

[45] Jul. 31, 1979

[54] DOUBLE-POLE SINGLE-THROW SWITCH

[76] Inventor: John J. Reiter, 6521 Stevens Ave. South, Minneapolis, Minn. 55423

[21] Appl. No.: 854,136

[22] Filed: Nov. 23, 1977

[51] Int. Cl.[2] ..... H01H 3/00; H01H 21/04

[52] U.S. Cl. ..... 200/153 M; 200/67 G

[58] Field of Search ..... 200/153 R, 153 G, 153 J, 200/153 HS, 153 M, 5 R, 17 R, 17 A, 17 B, 50 C, 335, 336, 246, 164 R, 5 F, 67 G, 6 R

[56] References Cited

U.S. PATENT DOCUMENTS

| | | | |
|---|---|---|---|
| 2,254,347 | 9/1941 | Blakesley | 200/153 M |
| 2,647,177 | 7/1953 | Huck | 200/5 R |
| 2,899,513 | 8/1959 | Schmidt | 200/67 |
| 2,936,347 | 5/1960 | Larkin | 200/6 |
| 3,082,309 | 3/1963 | Carissimi | 200/153 M |
| 3,337,703 | 8/1967 | Yamada | 200/67 |
| 3,361,888 | 1/1968 | Brackett | 200/153 M X |
| 3,439,138 | 4/1969 | Braun | 200/67 |
| 4,022,999 | 5/1977 | Brown | 200/67 G |
| 4,037,068 | 7/1977 | Gaynor | 200/5 F |

*Primary Examiner*—William Price
*Assistant Examiner*—Steven M. Pollard
*Attorney, Agent, or Firm*—Orrin M. Haugen; Thomas J. Nikolai

[57] ABSTRACT

A double-pole, single-throw electrical switch having a momentary make between a first set of contacts and a momentary break between a second set of contacts upon actuation thereof. The construction includes a box-like housing having first and second sets of normally closed contacts disposed therein, the contacts being arranged to cooperate with first and second rocker plates which are pivotally mounted within the housing. A latching mechanism and a return spring are operatively coupled to these rocker plates such that when a switch lever mounted on the housing is moved from a first to a second position, one of the rocker plates is rotated about the pivot from a first orientation to a second orientation, at which point the latch releases, and the return spring moves the rocker plate to its first orientation. During the travel of the rocker plate, the first set of contacts is electrically closed, but upon its return to the first orientation, the first set of contacts re-open. When the switch lever is subsequently thrown from its second position to its first position, the second rocker plate moves from a first to a second orientation, and upon reaching the second orientation, its latch releases, thus allowing its return spring to move the second rocker plate back to its first orientation. The second rocker plate is designed such that when it is in its first orientation, its associated set of contacts are closed, but are opened during its travel from the first orientation to the second orientation and back to its first orientation. In an alternative embodiment, the second rocker plate is modified such that the second set of contacts remain electrically closed except when the second rocker plate is in its first orientation.

10 Claims, 12 Drawing Figures

DOUBLE-POLE SINGLE-THROW SWITCH

BACKGROUND OF THE INVENTION

I. Field of the Invention

This invention relates generally to electromechanical switching apparatus and more specifically to the novel design of a double-pole, single-throw switch having a momentary make, momentary break feature. An alternative embodiment provides a similar arrangement, but having a momentary make and a continuous on, continuous off feature.

II. Description of the Prior Art

Many forms of double-pole, single-throw toggle type electrical switches are known in the art. A typical arrangement of such a switch is set out in the Schmidt U.S. Pat. No. 2,899,513. In this configuration three separate contacts are provided and when the toggle lever is in a first position, continuity is established between a first and a second contact, whereas when the toggle lever is in its opposite position, continuity is established between the first contact and a third contact. In certain applications, such as starting circuits for electric motors, it is desirable to have a double-pole, single-throw toggle switch in which a first set of contacts are only momentarily closed during the actuation from an OFF to a ON condition. During the momentary closure of the contacts, a current path may be established to the motor starting relay, allowing its contacts to close so as to connect the motor across the supply lines. Such an arrangement also includes a set of auxiliary relay contacts which serve to latch the relay coil across the lines to thereby maintain it in its energized condition. Thus, the motor continue to be energized so long as current continues to flow through the control relay. To turn off the motor, it is desirable that the electrical switch employed will momentarily break the electrical circuit energizing the relay. The momentary interruption of the current through the relay causes its contacts to open which disconnects the motor from the supply lines and also opens the auxiliary latching contact on the relay.

Prior art arrangements for use in motor control circuits have utilized separate START switches and STOP switches which are connected in series with the motor control relay across the supply mains. The START switch is generally of the normally open variety while the STOP switch is a normally closed arrangement. Thus, closure of the START switch completes a circuit through the control relay, the relay having a set of latching contacts which are effectively in parallel with the START switch contacts such that the START switch contacts may be re-opened without breaking the series circuit through the control relay. The operation of the STOP switch breaks the current path through the control relay, causing its contacts to drop out and disconnect the motor from the line.

The switch device of the present invention simplifies the motor Start-Stop control structure in that it provides in a unitary package of double-pole, single-throw switch which serves the same function as the prior art, separate START and STOP switches used in motor control applications.

SUMMARY OF THE INVENTION

In accordance with the teachings of the present invention, there is provided a box-like housing having first and second sets of normally closed contacts disposed therein. The contacts are positioned to cooperate with first and second rocker plates which are pivotally mounted within the housing. A latching mechanism and a return spring are operatively coupled to these rocker plates so that when the toggle lever of the switch is moved from a first to a second position, one of the rocker plates is rotated about the pivot from a first orientation to a second orientation, at which point the latch releases, and the return spring operates to move the rocker plate to its first orientation. During the travel of the rocker plate, the first set of contacts are electrically closed, but upon its return to the first orientation, the first set of contacts re-open. Thus, this first set of contacts may be connected in series with a motor control relay across the electrical supply lines to provide the momentary energization of the relay.

Subsequently, when the toggle lever of the switch is thrown from its second position back to its first position, the second rocker plate moves from a first to a second orientation, and upon reaching the second orientation, its latch releases, thus allowing its return spring to move the second rocker plate back to its first orientation. The second rocker plate is designed such that when it is in its first orientation, its associated set of contacts, i.e., the second set mentioned above, are closed, but are opened during its travel from the first orientation to the second orientation and back to its first orientation. The second set of switch contacts are connected in series with the normally-open auxiliary contacts of the relay and with the relay coil across the electrical supply mains. Thus, during the momentary interruption of the second set of contacts caused by the travel of the second rocker plate, this series circuit is momentarily interrupted, allowing the relay to drop out and disconnect the motor from the lines.

These and other features and advantages of the invention will become more apparent to those skilled in the art from the following detailed description of the preferred embodiments when considered along with the accompanying drawings in which like numerals in the several views refer to the same parts.

DESCRIPTION OF THE PREFERRED EMBODIMENT

Figure 1:
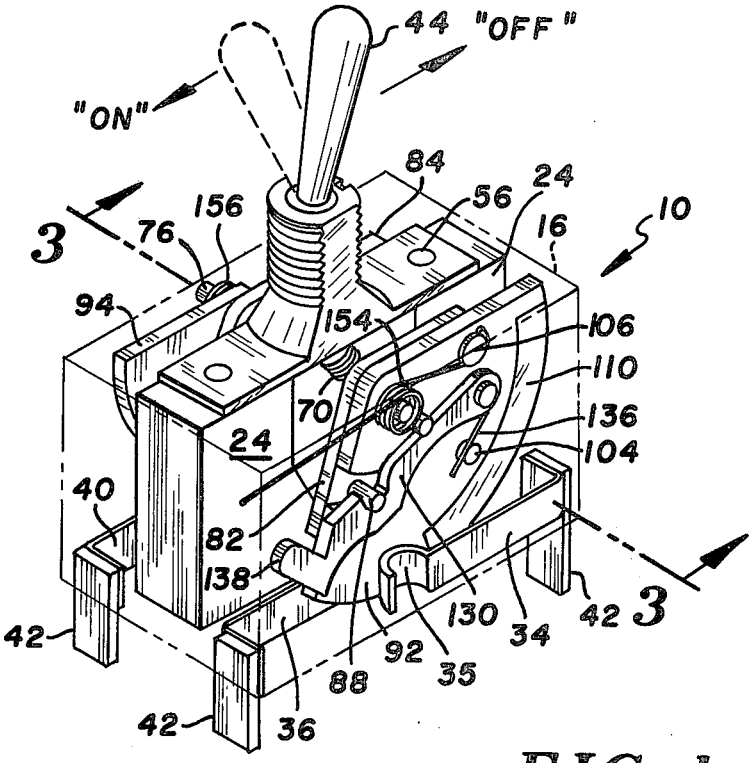
FIG. 1 is a perspective view of the preferred embodiment, partially in phantom, showing the momentary Make side of the switch.
Figure 2:
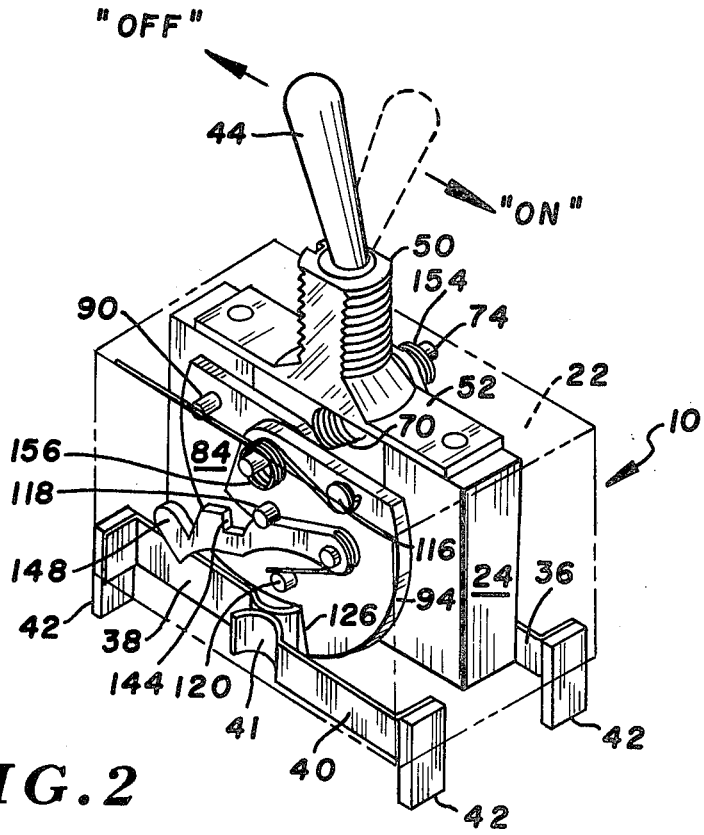
FIG. 2 is a perspective view of the preferred embodiment, partially in phantom, showing the momentary Break side of the device.
Figure 5:
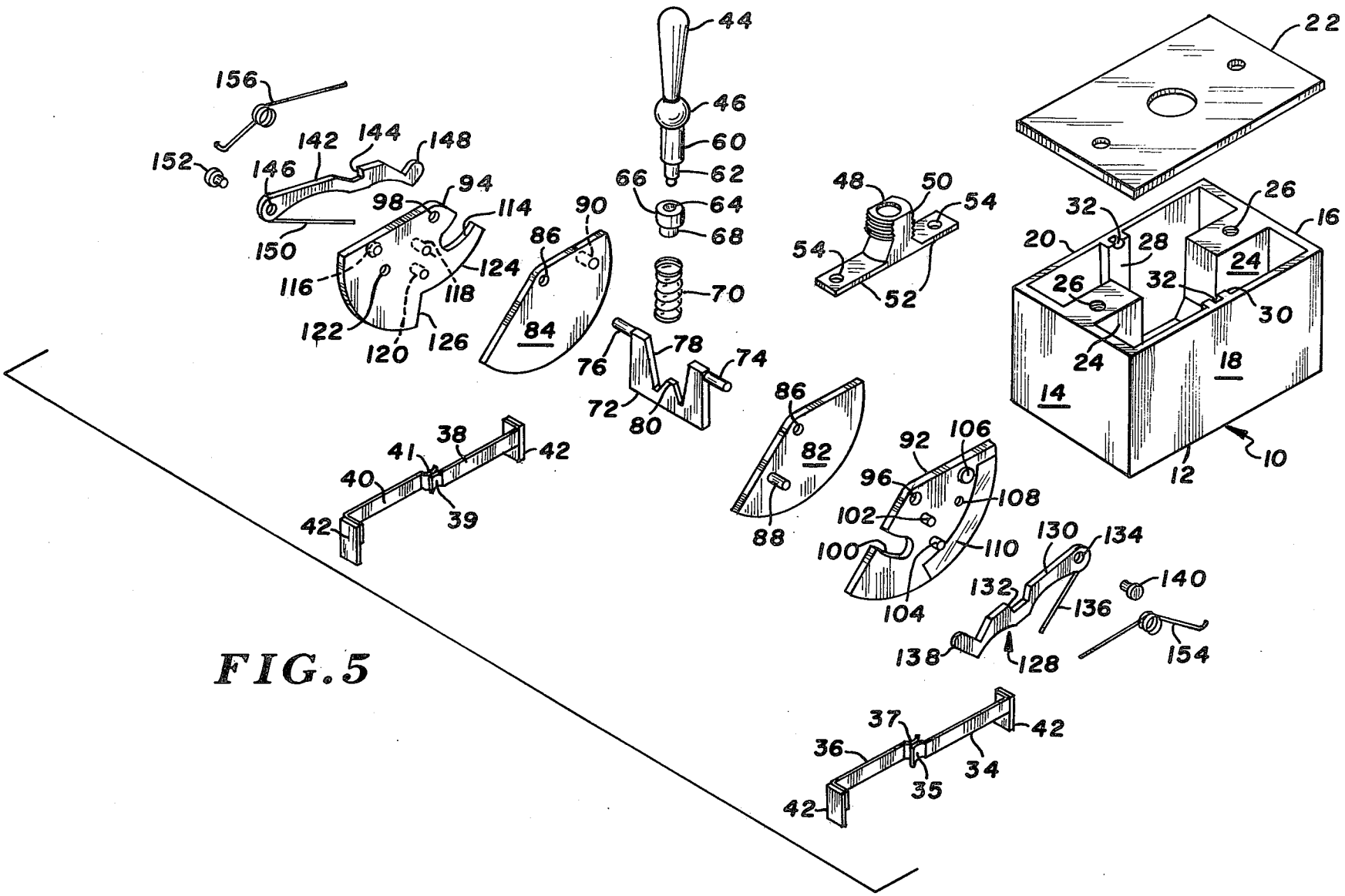
FIG. 5 is an exploded view illustrating the parts comprising the preferred embodiment and their orientation with respect to one another.

With reference to the drawings of FIGS. 1, 2 and 5, there is shown a first preferred embodiment of the invention. FIG. 1 is a perspective view showing the outer housing (indicated generally by numeral 10) in phantom so as to more clearly expose the cooperating relationship between the various internal parts comprising the invention. The view of FIG. 1 illustrates the "Make" side of the switch whereas FIG. 2 is oriented to show the features of the "Break" side of the switch.

With reference to the exploded view of FIG. 5, it can be seen that the housing 10 comprises a molded plastic housing having a generally rectangular bottom wall 12, end walls 14 and 16 and connecting side walls 18 and 20. The top of the housing 10 is generally open to allow insertion of the various operating parts, but following assembly, is adapted to be closed by a cover plate 22. Integrally formed within the molded, plastic housing 10 are a pair of block-like dividers 24 which extend inwardly into the enclosure defined by the side and end walls at points approximately midway along the width of the end walls 14 and 16. The opposing open faces of the dividers 24 are spaced apart from one another to define a channel therebetween. Mounting holes 26 are formed in the top surface thereof, the top surfaces being flush with the open edges of the end walls 14 and 16 and the side walls 18 and 20. Thus, a substantial surface is presented to the cover plate 22 to thereby yield a rather rugged construction.

Also integrally formed on the inner surfaces of the side walls 18 and 20 are inwardly extending rectangular posts 28 and 30 and these posts are located approximately midway along the length of the side walls 18 and 20 and generally centrally disposed with respect to the channel defined by the vertical edge surfaces of the divider blocks 24. Formed in the top surfaces of the posts 28 and 30 are semi-circular grooves 32. Formed in the bottom wall 12 of the housing 10 in proximity to the four corners thereof are narrow slits (not shown) which extend parallel to the end walls 14 and 16 for a short predetermined distance.

Now that the details of the construction of the housing 10 have been set forth, consideration will be given to the arrangement of the various operating parts of the switch within this housing.

First of all, first and second sets of leaf-spring type electrical contacts 34–36 and 38–40 are inserted into the housing in such a fashion that the bottom longitudinal edges thereof abut the inner surface of the bottom wall 12 with the contact end lugs 42 extending downward through the aforementioned corner slits (not shown) formed in the bottom wall 12 of the housing 10. Thus, the lugs 42 comprise terminal points for the switch to which external circuit connections may be made.

Figure 3:
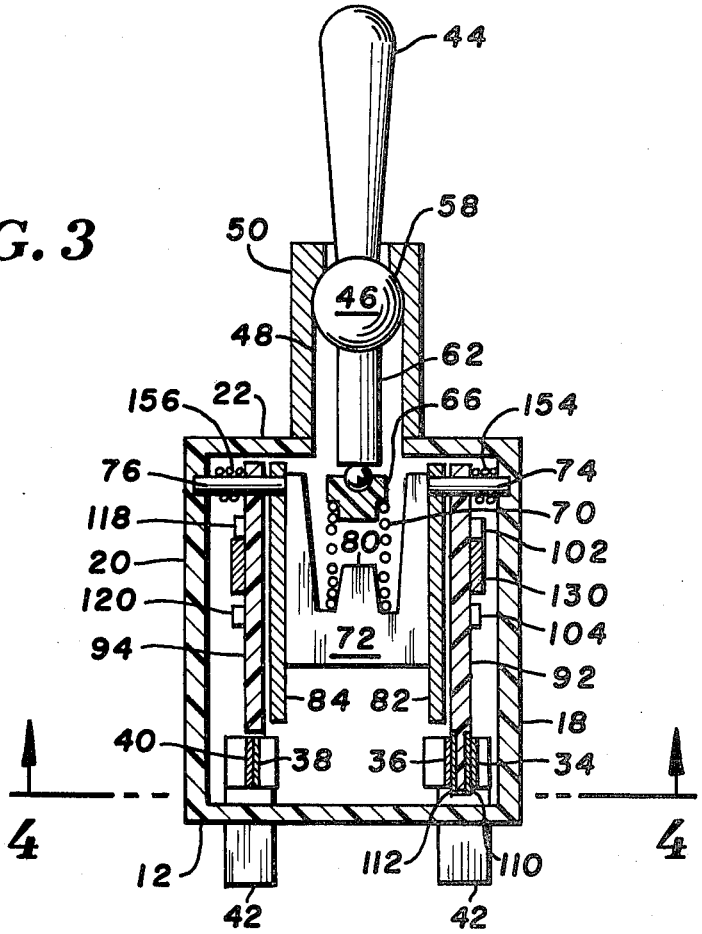
FIG. 3 is a cross-sectional view taken along the lines 3—3 in FIG. 1.

The switch operating mechanism further includes an actuating lever 44 which may be cast from a suitable metal so as to include an integrally formed ball swivel element 46 along its length. The actuating lever 44 is arranged to pass through a bore 48 formed in a crown member 50. The crown member 50 has an externally threaded cylindrical portion adapted to receive a ring nut (not shown) to facilitate the mounting of the switch on a panel (also not shown). The crown 50 includes at the base thereof laterally extending flanges 52 which are adapted to overlay the cover plate 22 and holes 54 are provided in these flanges to allow mounting screws to passs therethrough and through corresponding apertures formed in the cover plate 22 so as to be received by the bores 26 formed in the divider blocks 24. The lever 44 may be inserted into the bottom of the bore 48 in the crown and it extends outwardly therefrom with the ball swivel 46 mating with an inwardly projecting annular flange 58 (FIG. 3) formed within the crown 50.

Coaxially aligned with the lever portion 44, but on the opposed side of the ball swivel 46 is a cylindrical projection 60 (FIG. 5) having a concentric pin 62 extending from the lower base thereof. The ball-shaped terminus of pin 62 is adapted to fit within a central bore 64 formed in a cup member 66. The cup member 66 is generally cylindrical and has an annular recess 68 formed therein to define a flat shoulder at the intersection of the recess 68 with the cylindrical cup 66. The recessed portion of the cup 66 is adapted to fit within a helical spring 70, such that the shoulder abuts the upper flat surface of the spring 70.

Also included as a part of the switch mechanism is a swivel plate 72 which is generally rectangular and which has first and second cylindrical side trunnions 74 and 76 extending outwardly therefrom along the upper edge of the plate. Formed in the plate is a W-shaped notch 78, the notch being designed such that the central, upwardly-projecting protion 80 defined by the notch fits within the bottom opening of the coil spring 70. Disposed on either side of the swivel plate 72 and fixedly attached thereto are left and right side plates 82 and 84 respectively. Each of the side plates has generally the form of a predetermined segment of a circular disc and apertures 86 are formed at the center point of these circular segments such that the trunnions 74 and 76 may pass therethrough. As was mentioned, the side plates 82 and 84 are fixedly attached to the swivel plate 72 so as to rotate therewith. Disposed on the outer faces of the side plates 82 and 84 are pin-like projections 88 and 90, which, as will become more apparent hereinbelow, serve as latch pins during operation of the switch.

Also included in the assembly are first and second insulative rocker plates 92 and 94 which, too, comprise a predetermined segment of a circular disc and which have apertures 96 and 98, respectively, located at the approximate center of the circle from which the segment is formed. The diameter of the apertures 96 and 98 is somewhat larger than the corresponding diameter of the trunnions 74 and 76 such that the plates 92 and 94 are free to rotate or rock about the trunnions 74 and 76.

Considering first the configuration of the rocker plate 92, it can be seen that it includes an arcuate notch 100 which extends inwardly from one radial edge surface thereof, the location of this notch and the width thereof being selected so that when the rocker plate 92 rotates about the trunnion 74 of the swivel plate 72, the latch pin 88 projecting from the outer side surface of the swivel plate 82 may pass into and out of the notch 100. Extending outwardly from the side face of the rocker plate 92 are first and second cylindrical projections 102 and 104. For reasons which will become more apparent, the projection 102 may be termed a "latch abutment" whereas the projection 104 may be termed a "latch spring abutment". The rocker plate 92 includes a third cylindrical projection 106 extending outwardly from its side face, the projection 106 hereinafter being termed the "rocker plate spring abutment". A hole 108 is formed laterally through the insulative rocker plate 92 at the location indicated. There is also provided on each side of the insulative rocker plate 92 one of the two conductive arcs 110 and 112 (FIG. 3), which conductive arcs may be formed using conventional printed circuit techniques. The conductive arcs 110 and 112 are preferably embedded within the inner and outer side surfaces of the rocker plate 92 so that the outer surfaces of the conductive arcs will be flush with the surrounding insulative material used in the fabrication of the rocker plate 92. The conductive segments 110 and 112 disposed on the opposite arcuate surfaces of the insulator 92 are electrically interconnected either by a continuous, wrap-around edge surface or by a conductive pin (not shown).

The insulative rocker plate 94 is somewhat similar in its construction to the rocker plate 92 in that it includes an arcuate notch 114 corresponding to the notch 100 formed in the rocker plate 92. It also includes a rocker plate spring abutment 116 (FIG. 2) corresponding to abutment 106, a latch abutment 118 corresponding to abutment 102 and a latch spring abutment 120 corresponding to the abutment 104 on the rocker plate 92. Also included is a hole 122 corresponding to the hole 108 formed in the rocker plate 92. The construction of the insulative rocker plate 94 differs from that of the rocker plate 92 in that instead of having a conductive arc formed in proximity to the peripheral side surfaces thereof, the rocker plate 94 has a circumferentially extending recess 124 formed over a predetermined portion thereof to thereby define a radially extending edge 126 at a desired location along the peripheral edge.

Again, with reference to FIGS. 1 and 5, the assembly further includes a latch member, indicated generally by numeral 128, which comprises a lever bar 130 having a notch 132 formed in the upper edge thereof and a pivot hole 134 formed in proximity to a first end thereof. Disposed adjacent the pivot hole 134 is a resilient spring member 136 which depends generally downwardly from said one end and at an acuate angle with respect to the longitudinal axis of the lever bar 130. Formed at the opposite end of the lever bar 130 is an upwardly extending projection 138. A pivot pin 140 is adapted to pass through the hole 134 in the lever arm 130 and into the mating aperture 108 formed in the insulative rocker plate 92. Hence, the lever arm 130 is free to rotate about the pivot pin 140. The lower end of the resilient spring 136 rests against the inner surface of the latch spring abutment 104 to maintain tension on the spring and to normally urge the lever arm 130 against the latch abutment 102. Similarly, affixed to the outer side surface of the insulative rocker plate 94 is a latch lever arm 142 having a notch 144 in the upper edge thereof, a pivot hole 146 at a first end thereof and a projection 148 at its opposite end. Again, a latch spring member 150 is provided and this assembly is adapted to be pivotally secured to the rocker plate 94 by means of a pivot pin 152 which passes through the aperture 146 and into the hole 122 provided in the rocker plate 94.

During assembly, the swivel plate 72, having its side plates 82 and 84 and the outer rocker plates 92 and 94 mounted on the trunnions 74 and 76 with the latch assemblies 130 and 142 disposed on the outer side surfaces thereof in the manner indicated, are lowered into the housing 10, such that the ends of the trunnions 74 and 76 fit into the semi-circular grooves 32 formed in the side posts 28 and 30 of the housing. The side plate 82 and its associated rocker plate 92 are disposed between the divider 24 and the side wall 18 whereas the side plate 84 and its associated rocker plate 94 are disposed between the divider block 24 and the side wall 20 of the housing. Before inserting the assembly into the housing, however, first and second torsion wire springs 154 and 156 are disposed about the exposed ends of the trunnions 74 and 76 respectively with one end of the spring 154 engaging the rocker plate spring abutment 106 and its other end adapted to engage the inner surface of the top plate 22 when the top plate is secured to the housing 10. Similarly, a torsion spring 156 is mounted on the trunnion 76 with one end engaging the rocker plate spring abutment 116 and its other end adapted to engage the cover plate.

Now that the details of the construction and assembly of the preferred embodiment have been set forth in detail, consideration will be given to its mode of operation.

OPERATION

Figure 4:
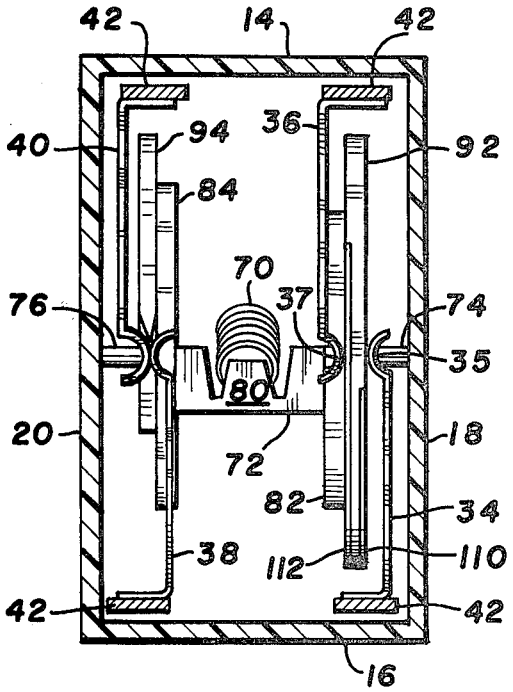
FIG. 4 is a bottom cross-sectional view taken along the lines 4—4 in FIG. 3.

The perspective views of FIGS. 1 and 2 illustrate the orientation of the various parts when the switch is in its "OFF" position. When the switch lever 44 is in its "OFF" position, the over-center spring 70 exerts a force on the swivel plate 72 tending to rotate the swivel plate 72 in a counterclockwise (CCW) direction when observed from its right side as shown in FIG. 1. The side plate 82, being fixedly attached to the edge of the swivel plate 72, rotates with the swivel plate 72 in the CCW direction when observed in FIG. 1. When in this orientation, the conductive arc segment 110 is out of engagement with the contact portion 35 of the leaf spring contact 34 and arc segment 112 is engaged with the contact portion 37 of the leaf spring contact 36 (FIG. 4). Because the contact portion 35 of leaf spring 34 abuts the face of the insulating rocker plate 92, contacts 35 and 37 are electrically isolated one from the other. With reference to FIG. 2, it can be seen that when the switch actuating lever 44 is in its "OFF" position, the torsion spring 156 acting between the top 22 of the housing and the rocker plate spring abutment 116 urges the rocker plate 94 in a CCW direction also. When in this orientation, the contact elements 39 and 41 are out of engagement with respect to the insulative surface of the disc 94 and, in fact, abut one another to establish electrical continuity between the leaf spring contacts 38 and 40.

FIGS. 6 through 9 are included to show the action of the latching mechanism when the switch actuating lever 44 is moved from its "OFF" position to its "ON" position. Beginning with FIG. 6, with the switch actuating lever 44 thrown to the right, the over-center spring 70 is urging the side plate 92 in the CCW direction and the latch pin 88 is passing through the arcuate notch 100 formed in the rocker plate 92 so as to reside in the notch 132 formed in the latch lever 130. The force of the spring 136 urges the lever 130 in the clockwise (CW) direction, but its travel is restrained by the latch pin 88. As was eariler indicated with respect to the view of FIG. 1, when the rocker plate 92 is in the CCW orientation, the contact portion 35 of the leaf spring contact 34 abuts the insulating side surface of the rocker plate 92 such that the contacts are electrically open.

Figure 7:
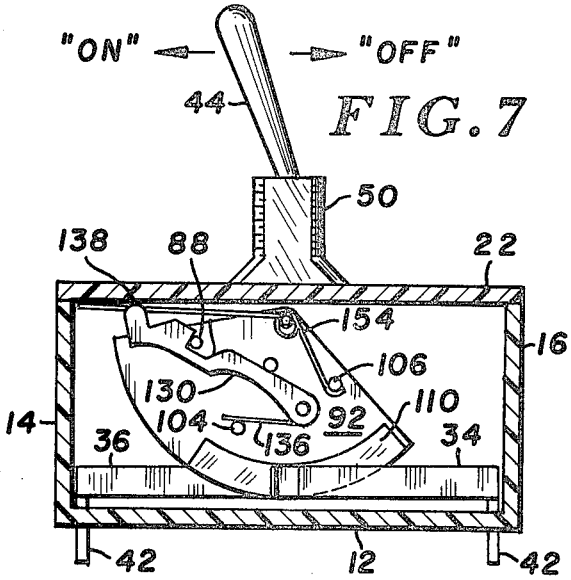

With reference to FIG. 7, the switch actuating lever 44 is in motion between its "OFF" and its "ON" position. As the lever 44 passes over-center, the spring coupling member 70 cooperating with the swivel plate 72 causes the side plate 82 to move in the CW direction. The latch pin 88 cooperates with the front edge of the notch 132 in the lever arm 130 and thereby causes the rocker plate 92 to also rotate in the CW direction against the force exerted by the rocker plate spring 154.

In FIG. 7, the lever 130 is illustrated at the point in its travel where its projection 138 just abuts the under surface of the cover plate 22. When the rocker plate 92 is in the orientation illustrated in FIG. 7, it can be seen that the conductive arc segments 110 and 112 disposed on either side of the insulating plate 92 have passed between the end portions 35 and 37 of the leaf spring contacts 34 and 36 such that these contacts are electrically closed of "made".

Figure 8:
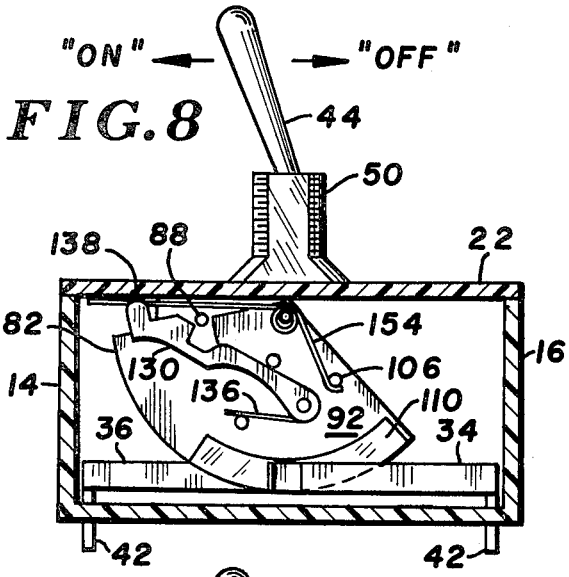

Next, considering the illustration of FIG. 8, continued CW rotation of the rocker plate 92 under the force exerted on it by the latch pin 88 causes the latch lever 130 to be depressed against the force exerted on it by its latch spring 136 until the point is reached when the latch pin 88 no longer engages the front edge of the notch 132. As soon as this point is reached, the torsion spring 154 which acts between the housing and the abutment 106 on the rocker plate 92 causes the rocker plate 92 to snap back in the CCW direction while the side plate 82 remains in its full CW orientation because of its connection to the switch actuating lever 44 through the swivel plate 72 and over-center spring 70.

Figure 9:
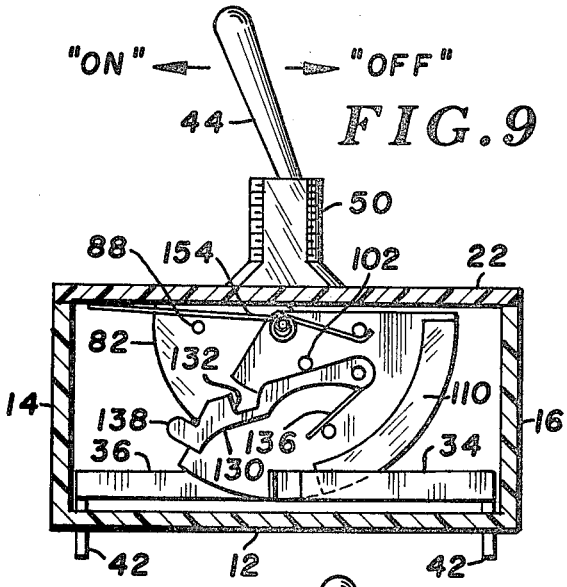

FIG. 9 illustrates the orientation of the various parts following the return of the rocker plate 92 to its full CCW position. Again, the contact portions 35 and 37 of the leaf spring contacts 34 and 36 are separated from one another by means of the insulative portion of the rocker plate 92 so that they are electrically open or broken. The latch lever 130 is resting against the lever abutment 102 under the force exerted by the resilient spring 136. The side plate 82 remains in its extreme clockwise orientation so long as the switch actuating lever 44 remains in the "ON" position.

Thus, it can be seen that as the switch lever 44 is moved from its "OFF" position to its "ON" position, an electrical circuit is momentarily established between the leaf spring contacts 34 and 36 but is subsequently reopened when the latch mechanism 130 releases and allows the rocker plate 92 to again rotate to its CCW orientation.

Figure 6:
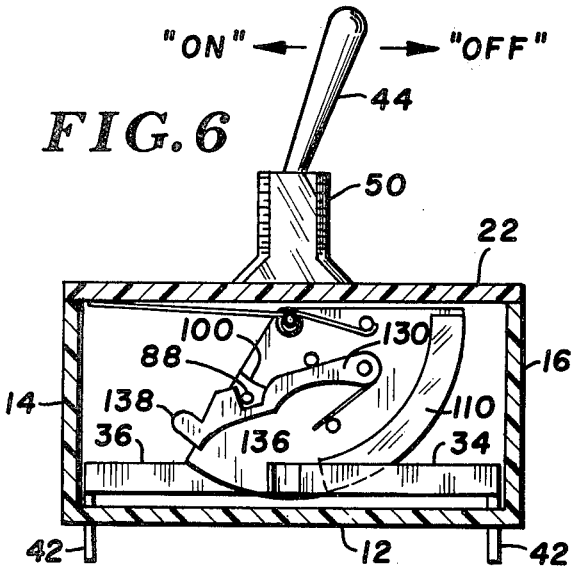
FIGS. 6 through 9 are side cross-sectional views illustrating the orientation of the various parts on the momentary Make side of the switch when the toggle lever is thrown from its OFF to its ON position.

With continued reference to FIG. 9, when the switch actuating lever 44 is again returned to its "OFF" position, as it passes through its center point, the side plate 82 will again rotate in the CCW direction, allowing the latch pin 88 to enter into the radial notch 100 of the rocker plate 92 so as to again assume its position in engagement with the notch 132 of the latch lever 130. This corresponds to the orientation of the various parts as illustrated in the view of FIG. 6.

Figure 10:
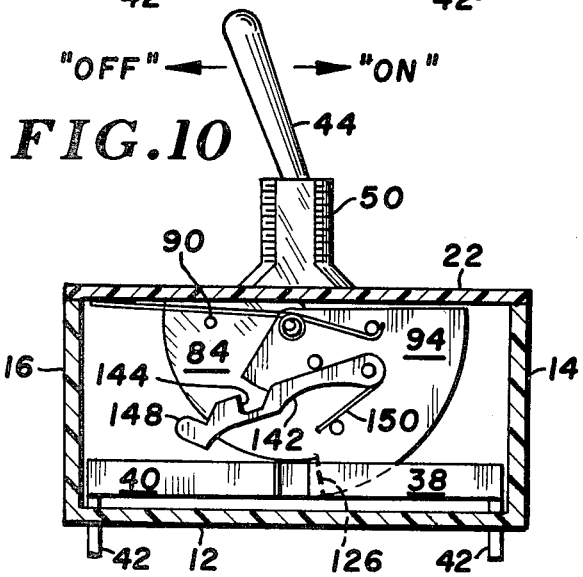
FIGS. 10 and 11 illustrate the orientation of the various parts of the momentary Break side of the switch when the toggle lever is thrown from its OFF to its ON position.

Next, attention is directed to the perspective view of FIG. 2 and to the side view of FIG. 10 which shows the arrangement of the various parts on the momentary break side of the switch when the toggle lever 44 is in its "OFF" position. Here, the side plate 84 is in its extreme CW position and the rocker plate 94 is in its extreme CCW position of travel. The latch pin 90 is disengaged from the radial notch 144 formed in the rocker plate 92 and is out of engagement with the notch 144 formed in the lever arm 142. It should be observed that when the rocker plate 94 is in the CCW orientation, the edge 126 of the recess 124 is out of engagement with the faces of the contacts 39 and 41 of the leaf springs 38 and 40. As such, the contacts are in abutment with respect to one another and the circuit path from contact 40 to contact 38 is closed.

Figure 11:
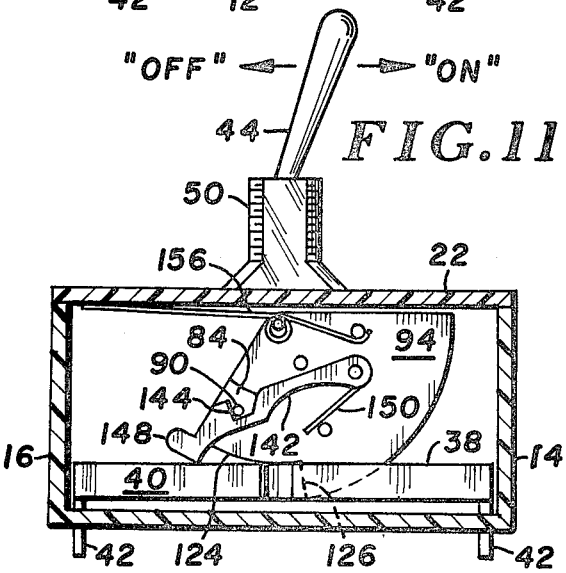

Now, with reference to FIG. 11, as the switch actuating lever 44 is moved to its "ON" position, the side plate 84 will be rotated in the counterclockwise direction until the point is reached where the latch pin 90 enters the arcuate slot 114 and engages the notch 144 formed in the latch lever arm 142. It will be apparent, then, that as the switch lever 44 is again returned to its "OFF"position, the side plate 84 will be rotated in a clockwise direction, with the latch pin 90 engaging the front edge of the notch 144 to thereby urge the rocker plate 94 in a clockwise direction and compressing the torsion spring 156. During its travel, the projection 148 on the lever arm 142 will abut the cover plate 22 and continued clockwise rotation of the side plate 84 will cause the latch lever arm 142 to be depressed against the force afforded by its spring biasing element 150. The pin 90 becomes disengaged from the notch 144 and the rocker plate 94 returns to its extreme CCW orientation because of the force exerted on it by the torsion spring 156.

In way of summary, then, when the toggle lever is initially in its "OFF" position, the "Make" side contacts 35 and 37 are open and the "Break" side contacts 39 and 41 are closed. As the toggle lever is moved on its "ON" position, the "Make" side contacts momentarily close while the "Break" side contacts remain in their normally closed condition.

A short time after the switch lever 44 reaches its "ON" position, the "Make" side contacts are again open and the "Break" side contacts are still closed. Now, when the toggle lever 44 is returned to its "OFF" position the "Make" side contacts 35 and 37 remain open and the "Break" side contacts 39 and 41 momentarily open and then re-close as the rocker plate 94 passes between the contacts 39 and 41 during its CW stroke and its subsequent CCW return stroke.

For reasons which should be apparent from the foregoing detailed description, the switch mechanism described comprises a double-pole single-throw switch having a momentary "Make" between a first set of contacts, occasioned by the movement of a switch actuating lever from a first to a second position and having a second set of contacts with a momentary "Break" upon return of the switch lever from its second position to the aforementioned first position.

ALTERNATIVE EMBODIMENT

Figure 12:
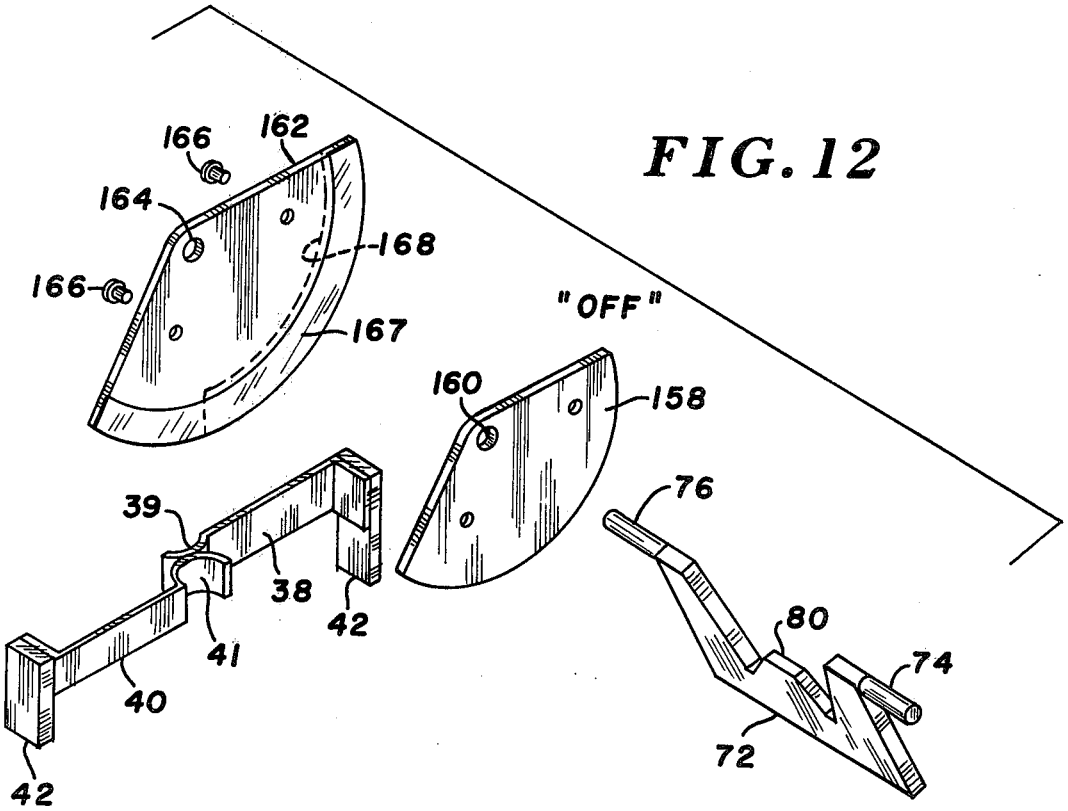
FIG. 12 is an exploded view showing one modification which may be made to the preferred embodiment.

Depicted in the exploded view of FIG. 12 is an alternative arrangement for the switch arrangement illustrated in the pictorial views of FIGS. 1 and 2 wherein the "Break" side rocker plate 94 is modified so that electrical continuity between contacts 38 and 40 is broken only when the switch lever 44 is in its "OFF" position. When the switch lever 44 is moved to its "ON" position, electrical continuity between the contacts 38 and 40 will be maintained.

More specifically, this alternative arrangement includes a side plate 158, again in the form of a segment of a circular disc, and having an axial hole 160 formed therein so as to slip over the trunnion 76. Again, the side plate 158 is fixedly attached to the side edge of the swivel plate 72. Thus, rotation of the swivel plate 72 about the trunnions 74 and 76 is accompanied by a corresponding rotation of the side plate 158. Attached to the outer flat surface of the side plate 158 is a rocker plate 162 having an axial aperture 164 formed therethrough so that the trunnion 76 may pass through this aperture. The rocker plate 162 may be fastened to the side plate 158 by means of rivets 166 which are adapted to pass through spaced apart holes in both the rocker plate 162 and the side plate 158.

Formed in proximity to the peripheral edge of the circular segment comprising the rocker plate 162 are conductive strips 167 and 168, these strips being located on opposed surfaces of the rocker plate 162. These strips are electrically connected, either by a wrap-around edge or by conductive pins (not shown). The length of one of the arcuate conductive strips 167 or 168 is such that when the rocker plate 162 is in its extreme CW orientation, which is the orientation achieved when the switch lever 44 is in its "OFF" position, one of the contact portions 39 or 41 of the leaf spring contacts 38 and 40 will abut the insulative surfaces of the rocker plate 162. The other arcuate contact strip may extend the entire peripheral length of the rocker plate. Hence, only one contact point 39 or 41 needs to be accurately positioned to insure that electrical continuity will be established between contacts 38 and 40 before the momentary "ON" contacts 34 and 36 become electrically closed during the actuation of the switch lever 44 from its "OFF" to its "ON" position.

It should be obvious that when the switch actuating lever 44 is moved to its "ON" position, the swivel plate 72 along with the side plate 158 and the rocker plate 162 will be rotated in the CCW direction such that the conductive strips 167 and 168 will bridge the contacts 39 and 41 to establish electrical continuity thereacross. Thus, when this assembly is used in place of the "Break" side contacts illustrated in the embodiment of FIGS. 1–11, the resulting switch will provide a momentary "Make" between electrical contacts 34 and 36 as the switch lever is moved from its "OFF" to its "ON" position and a positive "Make" between contacts 38 and 40. When the switch lever 44 is again returned to its "OFF" position, both sets of contacts will be open.

Because various changes could be made in the above described constructions without departing from the scope of the invention, it is intended that all matter contained in the above description or shown in the accompanying drawings shall be interpreted as illustrative and not in a limiting sense. The true scope of the invention is to be determined solely from the accompanying claims.

What is claimed is:

1. In an electric switch:

(a) a housing of insulating material having a recess in one face defining a bottom wall and side walls;

(b) a swivel plate having pivot means extending between opposed side walls, said swivel plate being disposed in said recess generally transverse to said opposed side walls;

(c) first and second side plates aligned parallel to said opposed side walls and fixedly secured to opposed side edges of said swivel plate for movement therewith, at least one of said side plates having a latch pin extending outwardly therefrom toward said opposed side walls;

(d) first and second rocker plates mounted outwardly of said first and second side plates on said pivot means for at least limited rotation thereabout, said rocker plates having the general shape of a segment of a circular disc and at least one of said rocker plates having an arcuate notch formed inwardly from one radial edge thereof for receiving said latch pin on said one of said side plates when said rocker plate is in a first orientation relative to said one of said side plates;

(e) spring biased latch means coupled to said one of said first and second rocker plates and adapted to cooperate with said latch pin on said one of said side plates;

(f) spring means operatively connected between said housing and said one of said first and second rocker plates for normally urging said one rocker plate to a predetermined orientation with respect to said housing;

(g) switch actuating means affixed to said housing and coupled to said swivel plate and movable between a first and a second position; and (h) first and second sets of electrical contacts disposed in said recesss proximate said bottom wall and said opposed side walls and generally aligned with said first and second rocker plates such that during at least a portion of the travel of said rocker plates, said contacts of said first set are separately said first rocker plate and said contacts of said second set are separated by said second rocker plate.

2. Apparatus as in claim 1 wherein said first rocker plate is formed from an electrically insulative material and includes interconnected conductive areas over predetermined arcs located proximate the periphery of said circular segment on each side thereof.

3. Apparatus as in claim 1 wherein said second rocker plate is formed from an electrically insulative material and includes an arcuate notch over a predetermined arc located proximate the periphery of said circular segment.

4. Apparatus as in claim 1 wherein said second rocker plate is formed from an electrically insulative material and includes interconnected conductive areas over predetermined arcs located proximate the periphery of said circular segment on each side thereof.

5. Apparatus as in claim 4 wherein the length of said arcs is such that when said switch actuating means is in said first position, at least one contact in said second set of electrical contacts abuts the electrically insulative material of said rocker plate on one side thereof and when said switch actuating means is moved to its second position, both contacts in said second set of electrical contacts abut said conductive areas on each side of said rocker plate.

6. Apparatus as in claim 3 wherein said length of said predetermined arc is such that when said switch actuating means is in either said first or said second position, said second set of electrical contacts abut one another through said arcuate notch.

7. Apparatus as in claim 2 wherein the length of said predetermined arcs is such that when said switch actuating means is in either its second or its first position, at least one contact in said first set of electrical contacts abuts the electrically insulative material of said one rocker plate on one side thereof.

8. Apparatus as in claim 7 wherein movement of said switch actuating means from said first to said second position rotates said one of said side plates in a first direction such that the engagement of said latch pin with said spring biased latch means on said one rocker plate carries said rocker plate therealong from an initial position for a predetermined distance whereat said latch pin becomes disengaged from said latch, allowing said spring means to return said rocker plate to said initial position.

9. Apparatus as in claim 1 wherein said switch actuating means comprises:

(a) a toggle lever mounted on said housing and rotatable between a first and a second position; and (b) a helical spring coupling said toggle lever to said swivel plate.

10. Apparatus as in claim 1 wherein each of said side plates has a latch pin extending outwardly from a side surface thereof towards said opposed side walls, wherein each of said rocker plates includes said arcuate notch formed inwardly from one radial edge thereof and wherein a spring biased latch means is coupled to each of said first and second rocker plates for cooperating with said latch pins on said side plates.

* * * * *

UNITED STATES PATENT AND TRADEMARK OFFICE

CERTIFICATE OF CORRECTION

PATENT NO. : 4,163,132

DATED : July 31, 1979

INVENTOR(S) : John J. Reiter

It is certified that error appears in the above-identified patent and that said Letters Patent are hereby corrected as shown below:

Column 10, line 12, Claim 1, "recesss" should read -- recess --.

Column 10, line 16, Claim 1, "separately" should read -- separated by --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*